US010335659B2

(12) United States Patent
Motokawa et al.

(10) Patent No.: US 10,335,659 B2
(45) Date of Patent: Jul. 2, 2019

(54) GOLF CLUB HEAD, METHOD FOR MEASURING PERFORMANCE OF THE SAME, AND METHOD FOR MANUFACTURING THE SAME

(71) Applicant: DUNLOP SPORTS CO. LTD., Kobe-shi, Hyogo (JP)

(72) Inventors: Yuki Motokawa, Kobe (JP); Naruhiro Mizutani, Kobe (JP); Jacob Lambeth, Irvine, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 15/643,247

(22) Filed: Jul. 6, 2017

(65) Prior Publication Data

US 2018/0311560 A1 Nov. 1, 2018

Related U.S. Application Data

(60) Provisional application No. 62/492,018, filed on Apr. 28, 2017.

(51) Int. Cl.

| | |
|---|---|
| ***A63B 53/04*** | (2015.01) |
| ***A63B 69/36*** | (2006.01) |
| ***A63B 60/42*** | (2015.01) |
| ***A63B 60/46*** | (2015.01) |
| *A63B 102/32* | (2015.01) |

(52) U.S. Cl.

CPC ..... *A63B 60/46* (2015.10); *A63B 53/0466* (2013.01); *A63B 60/42* (2015.10); *A63B 69/3617* (2013.01); *A63B 53/04* (2013.01); *A63B 2053/045* (2013.01); *A63B 2102/32* (2015.10); *A63B 2220/803* (2013.01); *A63B 2220/833* (2013.01)

(58) Field of Classification Search

CPC ..... A63B 69/3617; A63B 60/46; A63B 60/42; A63B 53/04; A63B 53/0466; A63B 2220/803; A63B 2102/32; A63B 2220/833; A63B 2053/045

USPC ..... 473/324–350, 287–292

See application file for complete search history.

(56) References Cited

U.S. PATENT DOCUMENTS

| | | | | |
|---|---|---|---|---|
| 6,932,716 | B2 * | 8/2005 | Ehlers | A63B 53/04 473/329 |
| 7,137,907 | B2 * | 11/2006 | Gibbs | A63B 53/02 473/329 |
| 7,935,003 | B2 * | 5/2011 | Matsunaga | A63B 53/0466 473/342 |

(Continued)

*Primary Examiner* — Sebastiano Passaniti
(74) *Attorney, Agent, or Firm* — Oliff PLC

(57) ABSTRACT

A golf club head having a striking face configured to impact a golf ball comprises the striking face comprising an effective striking area, the effective striking area having an expected COR value, defined by the following expression, not less than 0.810, $$\text{Expected } COR = \sum_{i=1}^{n}\sum_{j=1}^{m} p_{ij} * c_{ij}$$

wherein $p_{ij}$ is an impact probability at location or region (i, j) within the effective striking area, and $c_{ij}$ is a COR value of the location or region (i, j).

21 Claims, 15 Drawing Sheets

(56) References Cited

U.S. PATENT DOCUMENTS

| | | | | |
|---|---|---|---|---|
| 8,157,670 | B2 * | 4/2012 | Oldknow | A63B 53/0466<br>473/324 |
| 2002/0187852 | A1 * | 12/2002 | Kosmatka | A63B 53/04<br>473/330 |
| 2006/0068932 | A1 * | 3/2006 | Rice | A63B 60/00<br>473/329 |
| 2006/0094531 | A1 * | 5/2006 | Bissonnette | A63B 53/0466<br>473/329 |

* cited by examiner

FIG.5

| | | | | | | | | | | |
|---|---|---|---|---|---|---|---|---|---|---|
| | | | | | | | | | | up 15 mm |
| | | 0.769 | 0.797 | 0.795 | 0.793 | 0.808 | 0.789 | 0.777 | | up 10 mm |
| | 0.78 | 0.782 | 0.801 | 0.809 | 0.815 | 0.815 | 0.809 | 0.786 | 0.787 | up 5 mm |
| | 0.761 | 0.781 | 0.802 | 0.81 | 0.807 | 0.814 | 0.81 | 0.792 | 0.768 | center |
| | | 0.762 | 0.781 | 0.787 | 0.793 | 0.793 | 0.787 | 0.773 | 0.751 | down 5 mm |
| | | 0.737 | 0.749 | 0.75 | 0.767 | 0.753 | 0.754 | | | down 10 mm |
| | | | | | | | | | | down 15 mm |
| | toe 20 | toe 15 | toe 10 | toe 5 | center | heel 5 | heel 10 | heel 15 | heel 20 | |

GOLF CLUB HEAD, METHOD FOR MEASURING PERFORMANCE OF THE SAME, AND METHOD FOR MANUFACTURING THE SAME

TECHNICAL FIELD

The present invention relates to a golf club head, a method for measuring performance of the same, a method for manufacturing the same, and a method for providing information of the same.

BACKGROUND ART success in the game of golf is a function of a player's accuracy, judgment, and strength. To ensure fairness, the United States Golf Association (USGA) (as well as similar organizations) serves as a regulatory body governing the play, and equipment used in the play, of professional golf.

The USGA specifically sets forth rules limiting the ability of a golf club to transfer power to a golf ball, thereby limiting any advantage a golfer may seek over a competitor by equipment alone. This is generally accomplished by use of characteristic time (CT) measurement of the face of the club head. Characteristic time, for all purposes herein, refers to characteristic time as laid out, defined, and indicated as measured in the United States Golf Association's PROCEDURE FOR MEASURING THE FLEXIBILITY OF A GOLF CLUBHEAD, Rev. 1.0.0 (May 1, 2008).

However, golfers, particularly those with higher handicaps, tend not to impact golf balls, in the course of play, in a single location nor in the precise location desired by the golfer. Instead, throughout the course of play, ball impacts may occur at various locations of the striking face. In consideration of this, CT value, alone, may not be an accurate representation of the overall performance of the club head, particularly as handicap increases. Thus, a need exists for an accurate method of measuring the performance potential of a golf club head.

SUMMARY OF THE INVENTION

An object of a first invention is to provide a golf club head by which carry is increased for golfers with high handicaps. An object of a second invention is to provide an accurate method of measuring performance potential of a golf club head. An object of a third invention is to provide a method for manufacturing a golf club by which golfers with high handicaps increase carry.

The first invention is a golf club head having a striking face configured to impact a golf ball, the golf club head comprising the striking face comprising an effective striking area, the effective striking area having an expected COR value, defined by the following expression, not less than 0.810, $$\text{Expected } COR = \sum_{i=1}^{n}\sum_{j=1}^{m} p_{ij} * c_{ij}$$

wherein $p_{ij}$ is an impact probability at location or region (i, j) within the effective striking area, and $c_{ij}$ is a COR value of the location or region (i, j).

The second invention is a method for measuring performance of a golf club comprising following steps, a) a step of preparing a golf club head having a striking face, b) a step of identifying a plurality of locations or regions (i, j) on the striking face of the golf club head, c) a step of determining a coefficient of restitution $c_{ij}$ of each of the plurality of locations or regions (i, j), d) a step of generating or obtaining impact probability information of the plurality of locations or regions (i, j), e) a step of determining impact probability $p_{ij}$ of the plurality of locations or regions (i, j) based on the impact probability information, and f) a step of determining an expected COR based on the coefficient of restitution and the impact probability information according to a following expression:

$$\text{Expected } COR = \sum_{i=1}^{n}\sum_{j=1}^{m} p_{ij} * c_{ij}.$$

The third invention is a method for manufacturing a golf club comprising following steps, a) a step of preparing a prototype golf club head having a striking face, b) a step of generating or obtaining impact probability $p_{ij}$ of a plurality of locations or regions (i, j) on the striking face, c) a step of determining coefficients of restitution $c_{ij}$ of the plurality of locations or regions (i, j), and d) a step of modifying the prototype golf club head so as to raise the coefficient of restitution in the locations identified as having high impact probability.

BRIEF DESCRIPTION OF THE DRAWINGS

FIG. 5 is a table for explaining impact probabilities associated with the effective striking area.

DESCRIPTION OF THE PREFERRED EMBODIMENTS

An embodiment of the first to third inventions (and an additional fourth invention) will now be described in conjunction with accompanying drawings. For convenience of explanation, the second invention (a method for measuring performance of a golf club) will be described first.

Figure 1:
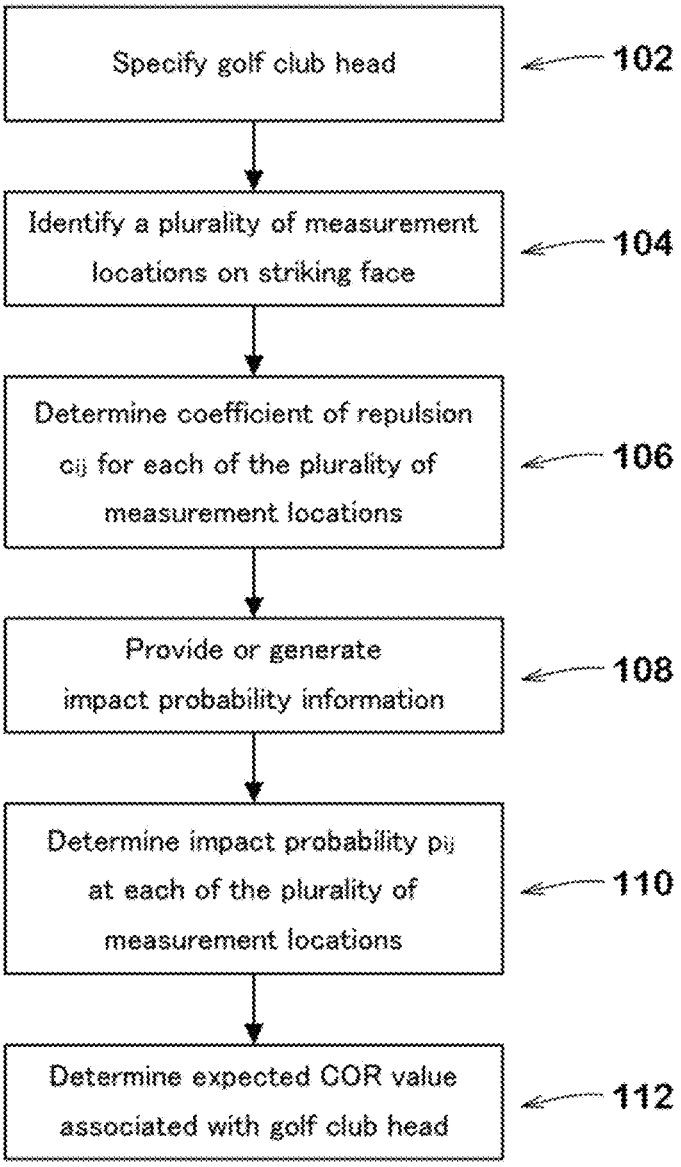
FIG. 1 is a flowchart showing a process according to an embodiment of the second invention.

In accordance with one or more aspects, referring to FIG. 1, a process is carried out for accurately assessing the performance of a golf club head. The temporal order of the steps discussed below is by way of example, and not intended to limit the scope of the disclosure, unless otherwise indicated, the below processes are not limited to the following steps or to the temporal nature of the steps as they are presented. Unless otherwise stated, the relative chronology of steps need not follow the particular order in which they are described below.

Figure 2:
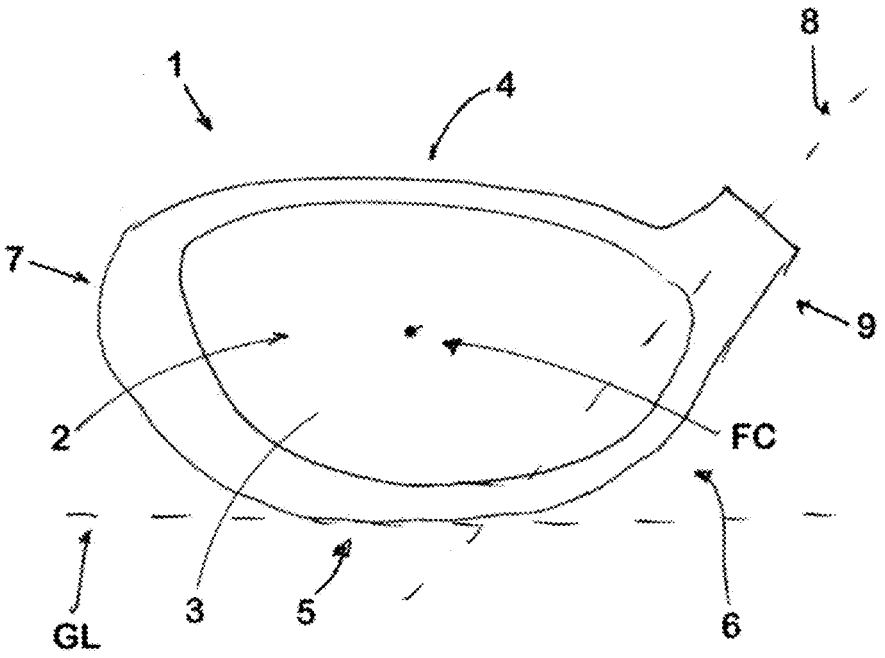
FIG. 2 is a front view of a golf club head.

In a first step 102, a golf club head is provided. By this step, for example, the golf club head to be assessed is specified. In FIG. 2, a golf club head 1 is shown. Preferably, the golf cub head is a wood-type club head, more preferably a hollow metal wood head, most preferably a driver-type club head. The golf club head 1 includes a striking wall 3 having a striking face 2 configured to impact a golf ball, a top wall 4 extending rearward from the striking face 2, and a bottom wall 5 extending rearward from the striking face 2 and opposite the top wall 4.

Figure 3:
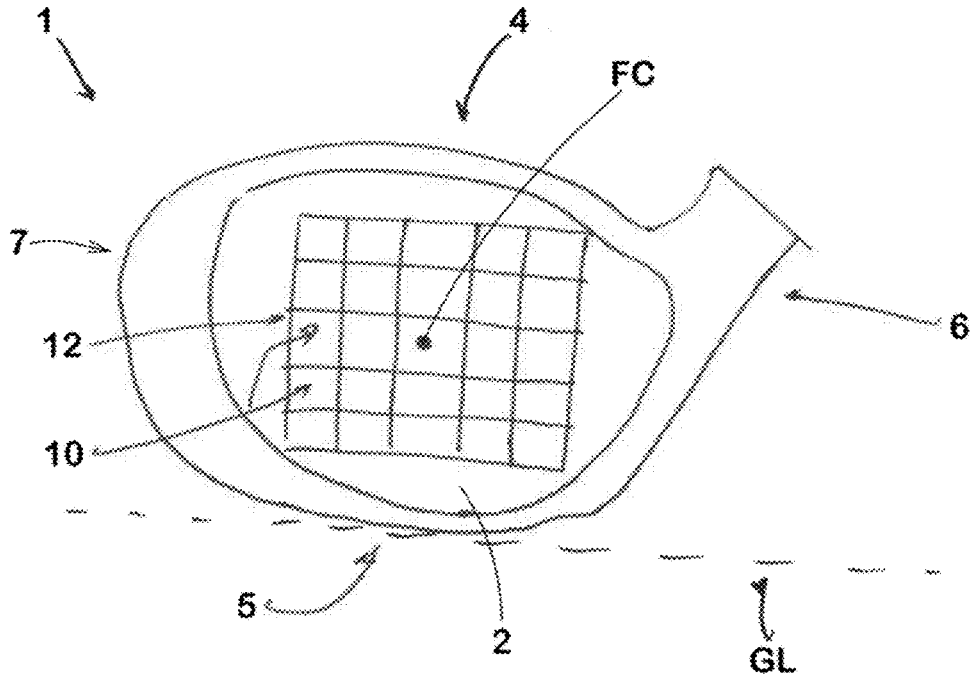
FIG. 3 is a front view of a golf club head in which an effective striking area of an embodiment is depicted.

Next, in Step 104, a plurality of measurement locations are identified and superimposed on the striking face 2 of the golf club head 1. As shown in FIG. 3, preferably, the measurement locations represent regions having boundaries laid out at constant intervals along both of a heel-to-toe direction (a direction from a heel portion 6 to toe portion 7) and a top-to-bottom direction (see FIG. 3 for both), with a virtual origin, for example, corresponding to the face center FC of the club head 1.

The face center FC, as used in this specification, is located using a standard template. The template has a coordinate system with a heel-toe axis orthogonal to a top-bottom axis. An aperture is disposed at the origin of the coordinate system, with the axes being graduated into evenly spaced increments. The template may be made of a flexible material, for example, a transparent polymer. A location of the face center FC is determined by initially applying the template to the striking face 2 so that the aperture is approximately in the middle of the striking face 2 and the heel-toe axis is generally horizontal.

The template is then translated in the heel-toe direction along the striking face 2 until heel and toe measurements along an axis at opposite points on a striking face perimeter of the striking face 2 proximate respective ones of the heel portion 6 and the toe portion 7 have the same absolute value. Once the template is centered with respect to the striking face 2 in the heel-toe direction, the template is translated into the top-bottom direction along the striking face 2 until measurements along the axis at opposite points on the striking face perimeter of the striking face 2 proximate respective ones of the top wall 4 and the bottom wall 5 have the same absolute value.

The above sequence is repeated until the absolute value of the heel measurement along the axis is equal to that of the toe measurement and the absolute value of the bottom measurement along axis is equal to that of the top measurement. A point is then marked on the striking face 2 through the aperture to designate the face center FC. A locating template is referenced in the united States Golf Association's Procedure for Measuring the Flexibility of a Golf clubhead (Revision 2.0, Mar. 25, 2005) and is available from the USGA.

In other embodiments, the reference point may be an intersection of a hosel axis 8 in the striking face 2 as projected with the club head 1 in front elevation and oriented in a reference position relative to a ground plane GL.

The golf club head 1 is depicted as being in the "reference position." As used in this specification, the "reference position" denotes a position of the club head 1 wherein the bottom portion 5 of the club head 1 rests on an imaginary ground plane such that a hosel centerline of a hosel 9 lies in an imaginary vertical hosel plane that contains an imaginary horizontal line generally parallel to the striking face 2. At this time, the golf club head 1 is held at predetermined lie angle and loft angle. Unless otherwise indicated, all parameters in this specification are specified with the golf club head 1 in the reference position.

As shown in FIG. 3, in some embodiments, the plurality of measurement locations corresponds to square or rectangular regions, or "bins," 10 having heights and widths of 5 mm, for example. The bin 10 located at a central origin defines a center that coincides with the face center FC of the club head 1. Other bins 10 are adjacently aligned horizontally and vertically to form a bin matrix 12, where geometric centers of the plurality of bins are spaced at respective 5 mm intervals from the geometric center of the central bin, both vertically and horizontally.

Figure 4:
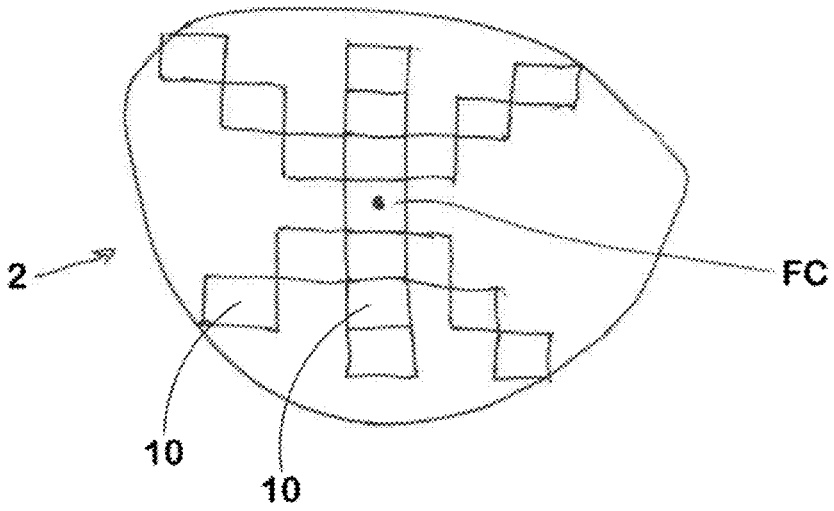
FIG. 4 is a front view of a golf club head in which the effective striking area of another embodiment is depicted.

In other embodiments, the measurement locations correspond to points rather than area regions. In yet other embodiments, the measurement locations correspond to area regions that are spaced from each other and thus do not abut. In yet other embodiments, orientations of the "bins" 10 do not form a matrix, but rather an irregular arrangement of the bins or other geometry configuration, e.g. an annulus or sunburst (see FIG. 4). It is preferred that the area of the striking face 2 designated to the measurement bins 10 configured as such constitutes an area (hereinafter referred to as "effective striking area")+/−22.5 mm horizontal and +/−12.5 mm vertical from the face center FC.

Next, in Step 106, coefficient of restitution (COR) values are determined and assigned to each of the plurality of bins 10. It is preferred that the COR values are determined using conventional cannon testing in conformance the USGA prescribed method for determining the COR. It is preferred that, for each of the bins 10 configured as such, an impact (or testing set of a plurality of impacts) is measured at the geometric center of the bin 10 or, in some embodiments, at a plurality of locations within the bin and averaged. A COR "map" is then optionally generated of the striking face 2 results, e.g. the COR map as shown in FIG. 5.

Figure 6:
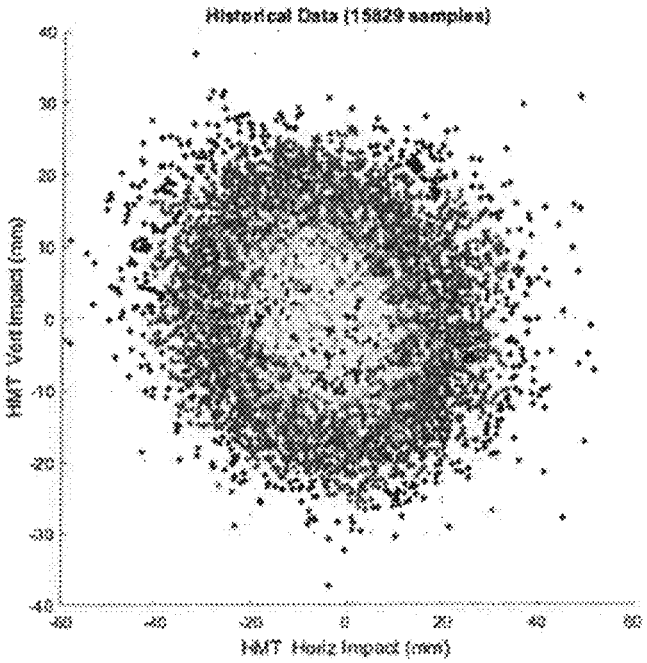
FIG. 6 is a graph showing impact probability information of an embodiment.

Next, in Step 108, impact probability information is either generated or obtained and correlated with each of the plurality of the bins. In some aspects, cameras, a launch monitor, sensors, accelerometers, piezoelectric materials, position sensors, etc., are used to track and memorialize impact locations for a predetermined pool of users. It is preferred that the pool of users constitutes a representative cross-section of golfing public, e.g. selected such that a handicap profile of the pool is proportional to known or understood handicap profile curves of the golfing public. In other embodiments, a particular segment (e.g. "high handicappers" or "low handicappers") of the golfing public is selected and a pool of players is particularly selected to match such particular segment. In any such embodiment, impacts among players are optionally aggregated and plotted relative to the plurality of the bins to generate an impact-frequency map (e.g. as shown in FIG. 6).

Next, in Step 110, impact probability values are calculated for each of the plurality of the bins 10. In some embodiments, primarily, the probability of impacts within all bins 10 compared to total impacts (i.e. including impacts occurring outside all bins 10) is calculated. In some embodiments, the bin 10 by bin probability may be expressed in terms of a probability matrix P, e.g. as follows, where the probability of impact at location (i, j)=$p_{ij}$.

$$P = \begin{bmatrix} p_{11} & \cdots & p_{1m} \\ \vdots & \ddots & \vdots \\ p_{n1} & \cdots & p_{nm} \end{bmatrix}$$

Similarly, in some embodiments, the bin 10 by bin COR values determined in step 106 may be expressed in terms of a COR matrix C, e.g. as follows, where the COR at location (i, j)=$c_{ij}$.

$$C = \begin{bmatrix} c_{11} & \cdots & c_{1m} \\ \vdots & \ddots & \vdots \\ c_{n1} & \cdots & c_{nm} \end{bmatrix}$$

Next, in Step 112, an "expected COR" value is generated based on the bin-by-bin (or location-by-location) impact probability information (generated in Step 110) and the bin-by-bin (or location-by-location) COR information. The expected COR value may be considered to represent a probability-adjusted measure of club head performance that a typical golfer would actually expect given how impacts are actually dispersed about the striking face 2 of the club head 1. In other words, it can also be considered to be an "expected coefficient of restitution" or a "coefficient of restitution that can be exerted when used by an actual golfer." Thus, using this information, a golfer may make a more informed decision in selecting a golf club based on its performance. Alternatively, or in addition, a golfer may determine which clubs out of a plurality of golf clubs may be better suited to the golfer's specific needs, e.g. based on handicap or other measure of skill level.

In some embodiments, the probability-adjusted performance value is denoted "expected COR" and may be represented as the sum E[C] as defined below:

$$\text{Expected } COR = \sum_{i=1}^{n} \sum_{j=1}^{m} p_{ij} * c_{ij}$$

Alternatively, or in addition, if the COR map and probability distribution (joint density) were considered as continuous functions, the expected COR value could be represented as follows:

$$\text{Expected } COR = \int_{-\infty}^{\infty} \int_{-\infty}^{\infty} p(x, y) * c(x, y) dx dy$$

The above process bears with it particular benefits. For example, using the above process, information could be provided to a user or users to better select an appropriate golf club head from among a plurality of different club heads, which may bear different "expected" COR values. Along the same lines, users may better identify, of a plurality of different golf clubs, which golf clubs are better suited for low-, mid-, and high-handicap players, respectively. Additionally, or alternatively, a manufacturer may associate the "expected COR" information as indicia on a particular golf club head to better communicate its latent properties to the user.

Notwithstanding the above direct benefits, additional functionality may be achievable based on the above processes and/or information determined therefrom. Such derived aspects will be described below.

Figure 7:
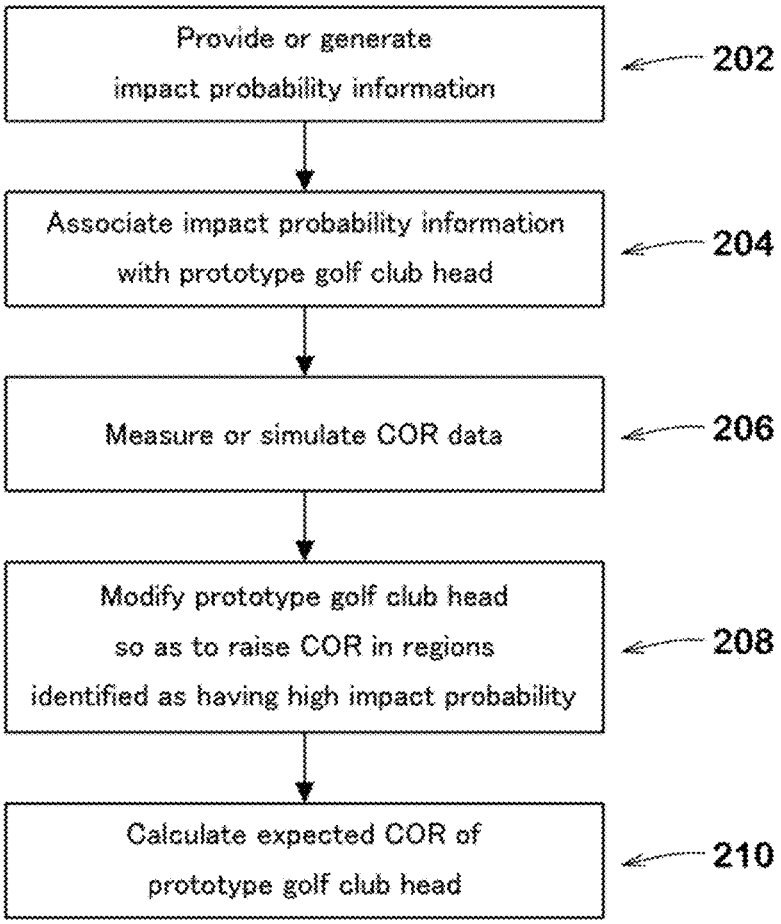
FIG. 7 is a flowchart showing a process according to an embodiment of the third invention.

For example, in the third invention, it is possible to provide a method for manufacturing a golf club by which, for example, a golfer having a high handicap increases carry. In some embodiments related to the third invention, the expected COR data may be used to design and manufacture a golf club head having improved performance. For example, as shown in FIG. 7, a method is shown for manufacturing (or improving upon) a golf club head, based on one or more process steps described above with regard to the embodiments shown in FIG. 2.

In Step 202, the impact probability information is generated or provided. Such information may correspond to the information generated or provided in step 102. In step 204, the impact probability information is associated with a prototype golf club head or golf club head as may be modeled electronically e.g. in conventionally available finite element analysis software.

Next, in step 206, the COR information (e.g. like the COR information determined in step 106 of the method shown in FIG. 2) is obtained. For a physical prototype golf club head, this information may be achieved using USGA COR testing protocol as described above. For electronic models, such testing may be simulated. It is preferred that, in some embodiments, the probabilities and the COR values are assigned on a bin-by-bin basis in like manner as described above with regard to the process of FIG. 2. Next, an expected COR value is generated based on the impact probability data and the COR data and outputted to a user, e.g. via electronic display and/or printer.

Finally, in Step 208, the golf club prototype or golf club model is modified, based on the expected information generated in steps 202, 204, and 206. In some embodiments, this modification occurs by a user, whereby bins 10 or other regions are identified as having relatively high impact probability and a relatively low COR value (or lower than necessary while still providing for adequate structural integrity of the club head and maintaining the club head, in its totality, as conforming to the regulations of the USGA and/or other regulatory body). This process may also involve an iterative process of modifying the structure of the club head, primarily the club face, to both decrease the COR value of bins 10 identified as having relatively low impact probability, and, in turn, raising COR value in bins identified as having the opposite, i.e. relatively high impact probability and relatively low COR value.

Such modifications to the club head 1 may be carried out, e.g. by the selective placement/removal of discretionary mass and/or stiffening elements (e.g. ribs). It is a known aspect of golf club head design to consider the total mass of the club head (or the targeted total mass of the club head) as comprised of structural mass and discretionary mass. Structural mass generally refers to mass necessary to establish the minimal structural integrity necessary for the club head 1 to be operable for its intended use. Discretionary mass, on the other hand, refers to the remaining mass that, given a target mass budget, is not necessary for establishing the structural integrity of the club head and, thus, may be positioned primarily to manipulate mass and performance properties of the club head 1. For example, it is known that the COR of various locations about the striking face 2 may be manipulated by the selective thickening and thinning of regions of the striking face 2. Additionally, it is known to locate stiffening features such as ribs on portions of the striking face 2 and optionally in connection with other portions of the club head 1, e.g. the sole portion 5 and/or the top portion 4. Thus, the user, provided with the information generated in steps 202, 204, 206, 208, and provided with known relationships between the COR and the thickness of the striking face 2, may be afforded the capability of reforming the striking face 2 to generate a golf club head 1 having an increased expected COR. Finally, in Step 210, a new expected COR value is generated and outputted.

In some embodiments, steps 202 through 210 are carried out using a computer having a hardware processor, whereby program code is embodied on recordable medium. The code may be configured to cause the processor to, e.g., simulate the COR value generation using the finite element analysis, calculate the expected COR values. In some embodiments, a program stored on the recordable medium includes instructions for automatically prescribing point-by-point, region-by-region, or bin-by-bin, the thickness of the striking face 2 based on the information provided in steps 202 through 208 as well as predetermined relationships between variable striking face thickness and COR, and in a manner that is optimized for the particularly dimensioned and weighted golf club head provided.

In some embodiments, the process of FIG. 7 is carried out, but with the additional aspect that the provided or generated impact probability data corresponds to segmented user data, e.g. on the basis of handicap. In such case, different golf club heads may be generated that are selectively tailored to golfers of various skill strata.

Figure 8:
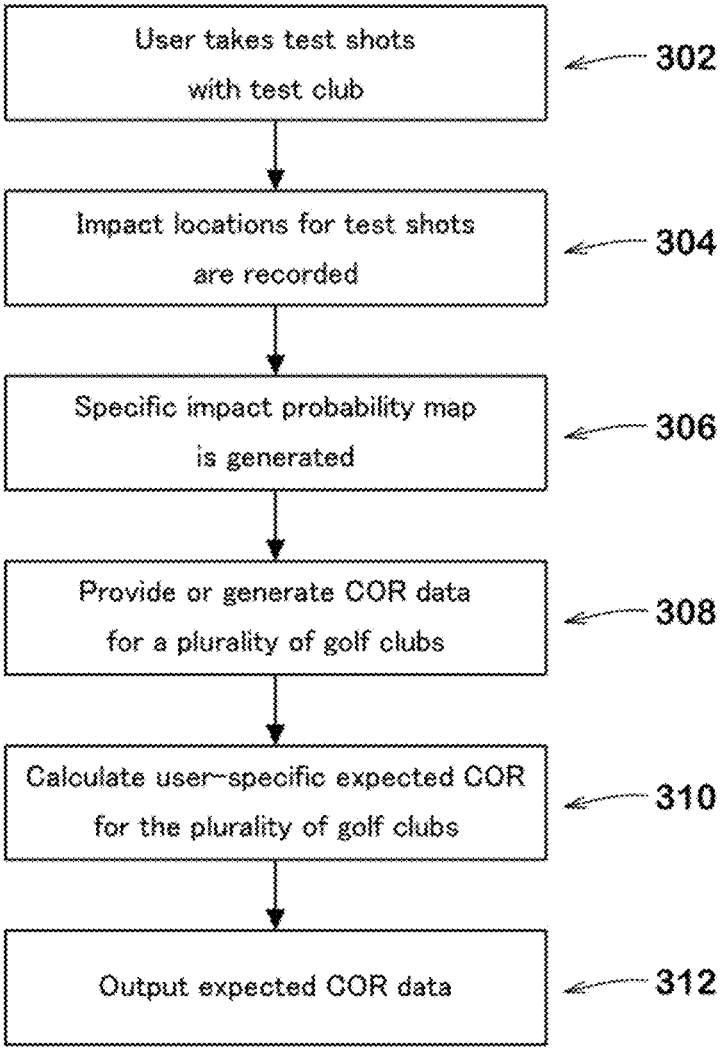
FIG. 8 is a flowchart showing a process according to an embodiment of the fourth invention.

A fourth invention relates, for example, to a method for providing useful information for a user to select a golf club. In some embodiments related to the fourth invention, a club selection process is carried out, e.g. at a retail or other public facility. Referring to FIG. 8, in Step 302, a golfer engages with a test golf club and hits a plurality of golf shots. In Step 304, using impact location sensors via an attachable electronic swing tracking device, and/or launch monitor using motion sensing devices, impact locations are recorded for each shot.

In step 306, using the computer having the processor, program code stored on the recordable medium is configured to instruct the processor to calculate user-specific impact probability information, preferably on a bin-by-bin basis as described above with regard to the method of FIG. 2. In some cases, the bin-by-bin probability information is directly calculated from the user impact points, e.g. the number of impacts per bin 10 are counted and normalized to the total number of impacts. However, in other cases (particularly where the number of total impacts is relatively low, e.g. less than 100), the impact locations are compared against a best-fit standard probability function, such as a Gaussian distribution, or other predetermined algorithmic relationship modeling impact distribution.

Next, in step 308, the COR information is provided, preferably in the form of bin-by-bin data for a plurality of golf clubs, which may be available to the user for purchase.

Next, in Step 310, based on the COR information and the impact probability information, the software is configured to instruct the processor to calculate the expected COR values for each of the plurality of golf clubs that may be available to the user. Next, in Step 312, the software instructs the processor to output the expected COR data to the user or other professional that may be assisting the user. The expected COR data may include the actual expected COR values for each golf club and/or information identifying which golf club resulted in the highest expected COR for such user, or a list of high-ranking expected COR golf clubs, optionally in order of highest to lowest. As a result, the golfer may be informed of which golf club may perform best given the golfer's particular impact distribution thumbprint.

The above aspect may be configured as a method for providing golf club information to a user, including, for example, the following steps.

a) A step in which a user hits a plurality of test shots with a test golf club having the striking face;

b) A step of recording impact locations of the test shots on the striking face;

c) A step of generating specific impact probability information of the user;

d) A step of providing or generating COR data at various locations of the striking face for a plurality of golf clubs; e) A step of calculating the expected COR of the user for the plurality of golf clubs; and f) A step of outputting the expected COR.

As described above, the USGA recently migrated from COR to CT as a means for quantifying the "springiness" of the striking face of the golf club head. Accordingly, it is to be appreciated that any discussion above regarding COR, including measuring or using the COR at any particular location on the striking face of the club head, is to be understood as an implied disclosure of providing the same measurement with regard to CT. Furthermore, although COR and CT may not necessarily be analogous measurements, for all practical purposes in this specification, any disclosed COR value (or change in COR) or CT value (or change in CT value) should be considered an implicit disclosure of a corresponding CT or COR value (or change therein), respectively, in accordance with the following formula. For example, any step of calculating COR on a bin-by-bin basis should be interpreted to include the alternative step of calculating CT on a bin-by-bin basis.

$$\text{CT value(in microseconds)}-(\text{COR value}-0.718)/0.000436$$

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

Next, some embodiments of the first invention will now be described.

Figure 9:
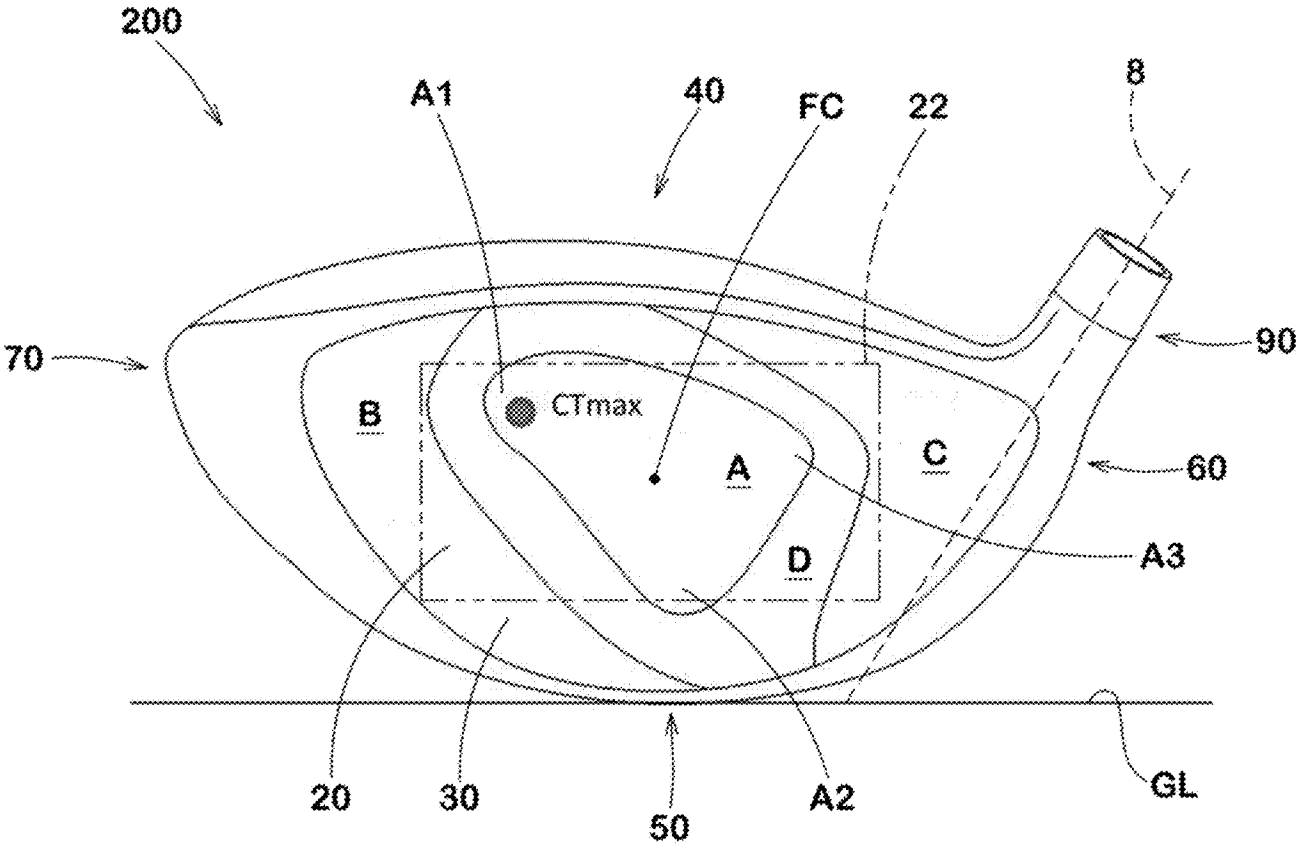
FIG. 9 is a front view showing a golf club head of an embodiment of the first invention.

FIG. 9 shows a front view of a golf club head 200. The golf club head 200 is shown as a wood type golf club head, preferably as a hollow metal wood head, most preferably as a driver type club head. Also in this embodiment, the club head 200 includes, for example, a striking wall 30 having a striking face 20 configured to impact a golf ball, a top wall 40 extending rearward from the striking face 20, a bottom wall 50 extending rearward from the striking face 20, a heel portion 60, a toe portion 70, and a hosel portion 90.

The golf club head 200 of FIG. 9 has an effective striking area 22 on the striking face 20. The effective striking area 22 is an area intended to be brought into contact with a golf ball so as to obtain a sufficient carry and directionality, and is determined in consideration of size of the golf ball, for example. In a preferred embodiment, the effective striking area 22 constitutes at least an area +/−22.5 mm horizontal and +/−12.5 mm vertical from a face center FC.

Figure 10:
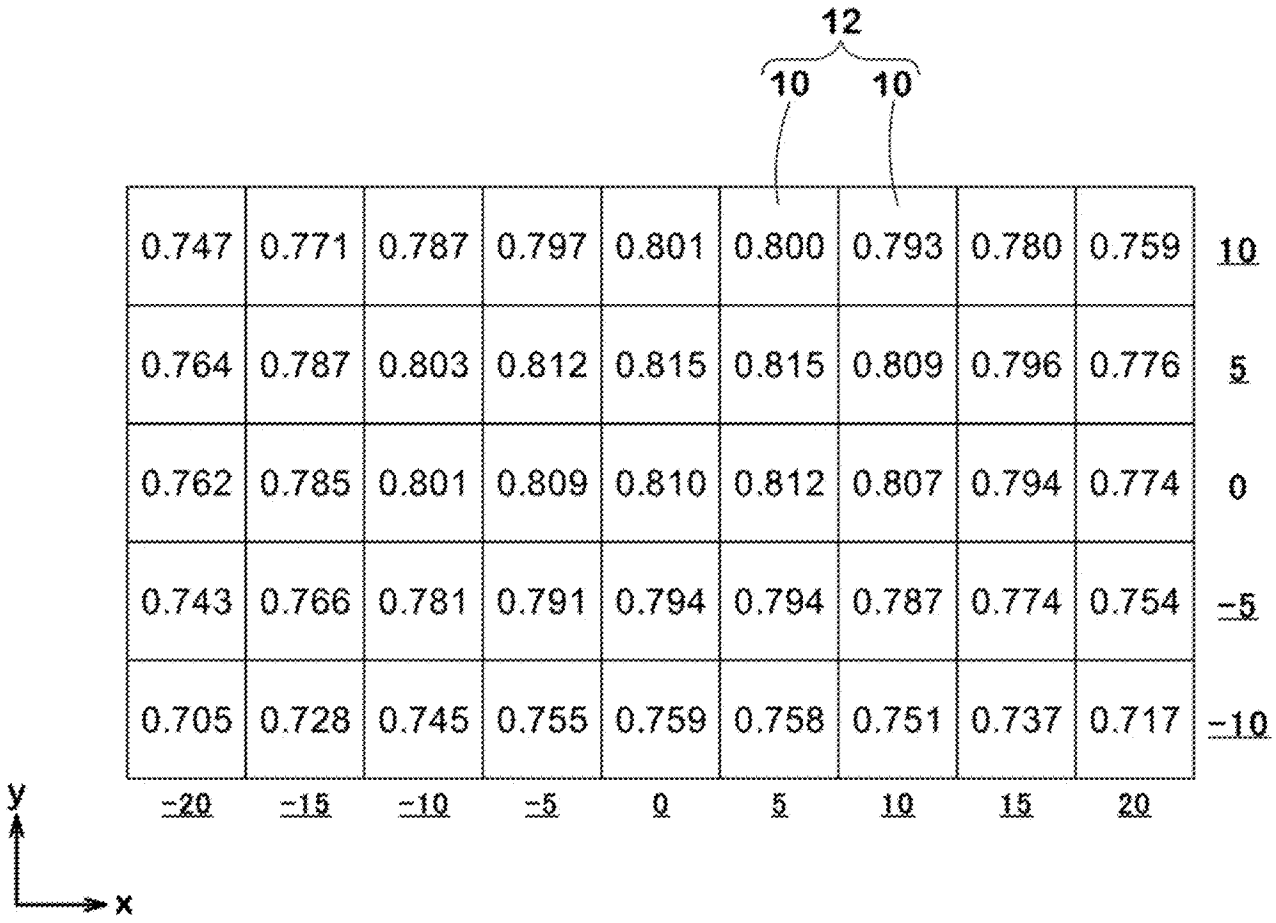
FIG. 10 is a diagram for explaining COR associated with the effective striking area of FIG. 9.

FIG. 10 shows a bin matrix 12 of the effective striking area 22 of the golf club head 200. In FIG. 10, an x-axis corresponds to a horizontal direction (the heel-toe direction) of the striking face 20, and a y-axis corresponds to an up-and-down direction of the striking face 20. Further, scales displayed outside the effective striking area represent distances (mm) from the face center FC. More specifically, each of the scale is the distance from the face center FC to the center of each of the bin matrix. The effective striking area 22 is partitioned into a plurality of the bins 10 so as to form the bin matrix 12. In this embodiment, the bin matrix 12 constitutes, for example, a 5×9 matrix. In each of the bin 10, as described in the embodiment of the second invention, a value of the coefficient of restitution specific to each bin, that is, COR ($c_{ij}$) is obtained in advance and defined. In this example, the value of COR is high around the face center FC and gradually decreases from there toward a perimeter of the effective striking are.

The impact probability information shown in FIG. 6, for example, is associated with this golf club head 200. In FIG. 6, a horizontal axis corresponds to the horizontal direction (the heel-toe direction) of the striking face 20 and a vertical axis corresponds to the up-and-down direction of the striking face 20, and the impact locations are plotted based on the result of the test shots. Scales of each axis represent the distances (mm) from the face center FC. Further, in FIG. 6, an effective impact count is 15829, and the plots overlap at a position where an impact frequency is high, which is displayed by a high lightness (that is, white). Contrarily, the plots are dispersed at a position where the impact frequency is low, and it is displayed by a plot with a color closer to black. Therefore, the impact probability information shows a tendency that the impact frequency is highest in the vicinity of the face center FC and the impact frequency decreases from the face center FC toward the striking face perimeter. As described in the disclosure of the second invention, the impact probability $p_{ij}$ is determined for each of the bin 10 in the effective striking area 22 based on the impact probability information. Table 1 shows the bin matrix in which the impact probability $p_{ij}$ obtained based on FIG. 6 is defined, and it corresponds to the bin matrix shown in FIG. 10.

TABLE 1

| | | | | | | | | |
|---|---|---|---|---|---|---|---|---|
| 0.79% | 1.69% | 1.97% | 2.80% | 3.12% | 2.98% | 2.55% | 1.83% | 1.22% |
| 0.86% | 1.69% | 3.51% | 4.09% | 3.76% | 4.41% | 2.90% | 1.79% | 1.18% |
| 0.75% | 1.86% | 3.33% | 4.30% | 4.70% | 3.26% | 3.62% | 2.37% | 1.15% |
| 0.72% | 1.90% | 2.15% | 2.76% | 2.69% | 2.87% | 2.44% | 1.25% | 1.00% |
| 0.47% | 1.15% | 1.33% | 1.61% | 2.44% | 2.37% | 2.01% | 1.69% | 0.68% |

Regarding the golf club head 200, when the impact probability at location or region (i, j) in the effective striking area 22 is $p_{ij}$ and the COR value of the location or region (i, j) is $c_{ij}$, the expected COR value of the effective striking area calculated by the below expression may be not less than 0.810.

$$\text{Expected } COR = \sum_{i=1}^{n}\sum_{j=1}^{m} p_{ij} * c_{ij}$$

Regarding golf club heads sold on the market so far, those having a high expected COR like this embodiment are not known. Therefore, the golf club head 200 in this embodiment (and a golf club comprising the golf club head 200 and a shaft attached thereto) is expected to have an effect of improving a carry of a golf ball more than ever for a golfer who cannot always strike a ball at a same position (for example, a middle and high handicap golfer).

Methods of effectively increasing the expected COR include, for example, (a) increasing a $COR_{max}$, (b) increasing a value of moment of inertia (MOI) around a vertical axis passing through a center of gravity of the head, and (c) bringing a position with the highest impact frequency in a distribution of impact points closer to a position of the $COR_{max}$, and so on, and it is preferred that at least one of these is applied. Note that the "$COR_{max}$," is a maximum value of the COR at an arbitrary position on the striking face of the golf club head, and that "$CT_{max}$" is a maximum value of the characteristic time (microseconds) within the effective striking area measured by the above-described USGA procedure.

As a means of increasing the $COR_{max}$ in the (a) method above, for example, it is effective to decrease thickness of the striking face 20. As a means of increasing the MOI in the (b) method above, for example, it is effective to increase a head volume and to allocate more weight to the toe and the heel of the golf club head 200. In the (c) method above, it is effective to bring a sweet spot closer to the position with the highest impact frequency on the striking face 20, or the like.

Figure 11:
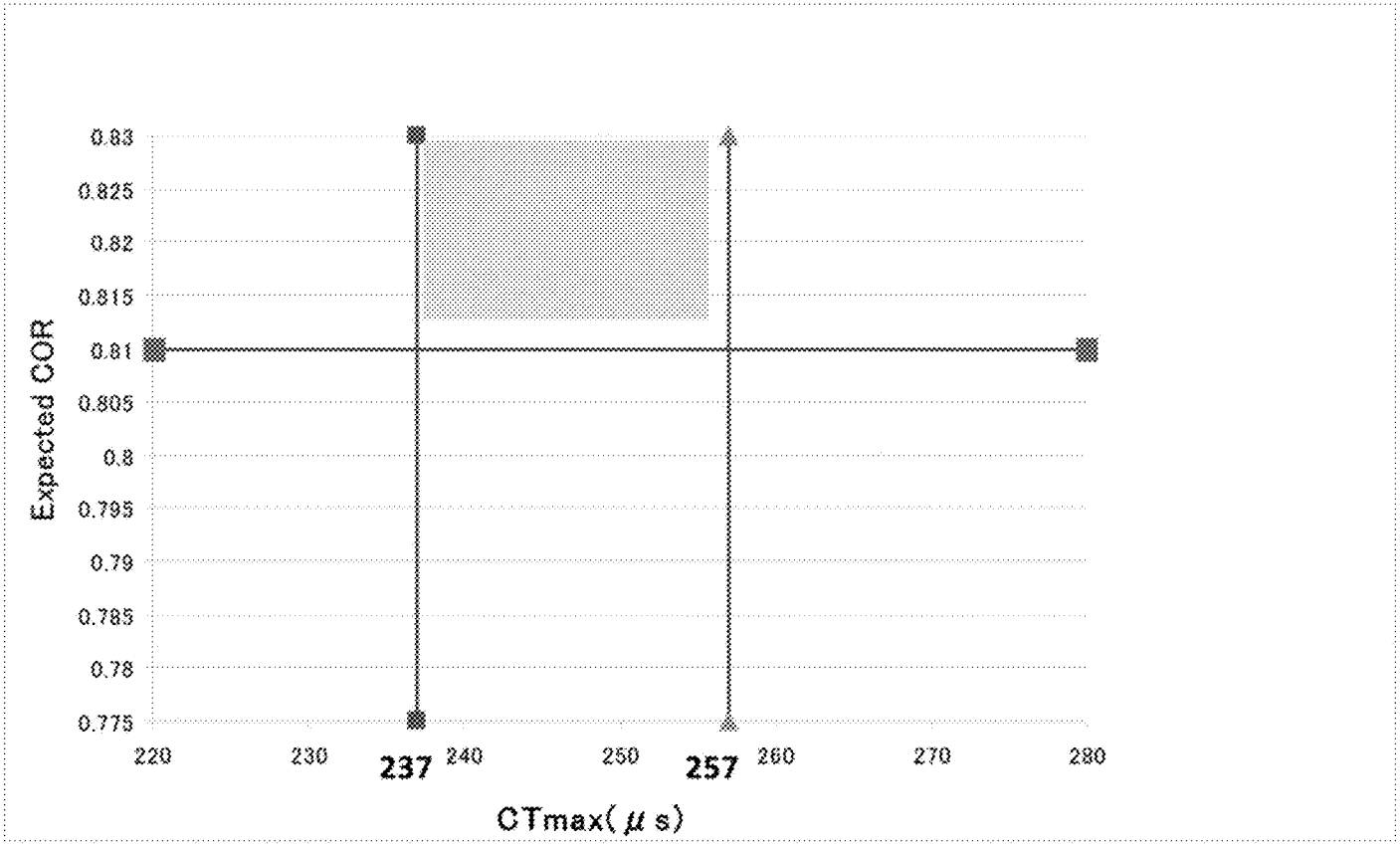
FIG. 11 is a graph showing relationship between expected COR and maximum value of characteristic time.

In some aspects, the golf club head 200 can be configured in consideration of the CT as well as the expected COR. For example, in view of USGA rules, the golf club head 200 may be configured to have the characteristic time (CT) not greater than 257 microseconds. Further, in some aspects, it may be configured to have the CT not less than 237 microseconds. FIG. 11 shows a graph showing relationship between the expected COR and the $CT_{max}$. In FIG. 11, a range of the golf club head that satisfies numerical ranges of the expected COR and the CT is shown in gray.

Figure 12:
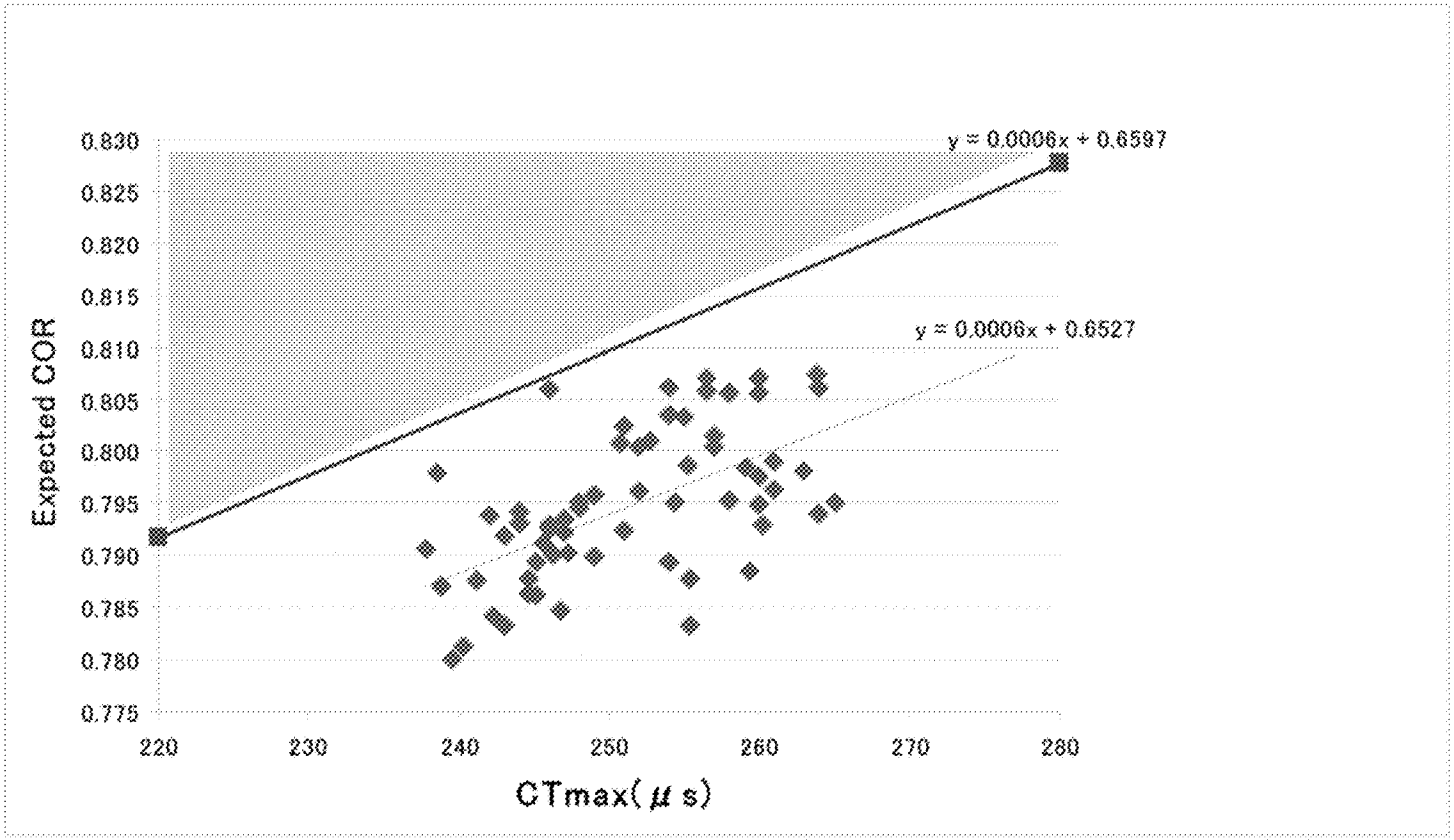
FIG. 12 is a graph showing relationship between expected COR and maximum value of characteristic time.

FIG. 12 shows results of examining the expected COR and the $CT_{max}$ for conventional wood type golf club heads. According to experiments of the inventors, the expected COR and the $CT_{max}$ of the conventional wood type golf club heads are roughly summarized by the following regression expression:

$$\text{Expected COR} = 0.0006 \times CT_{max} + 0.6527.$$

In order to further increase the expected COR while maintaining the relationship between the expected COR and the $CT_{max}$ of the conventional wood type golf club heads, the golf club head 200 may be configured so as to satisfy relationship of the following expression:

$$\text{Expected COR} \geq 0.0006 \times CT_{max} + 0.6597.$$

Figure 13:
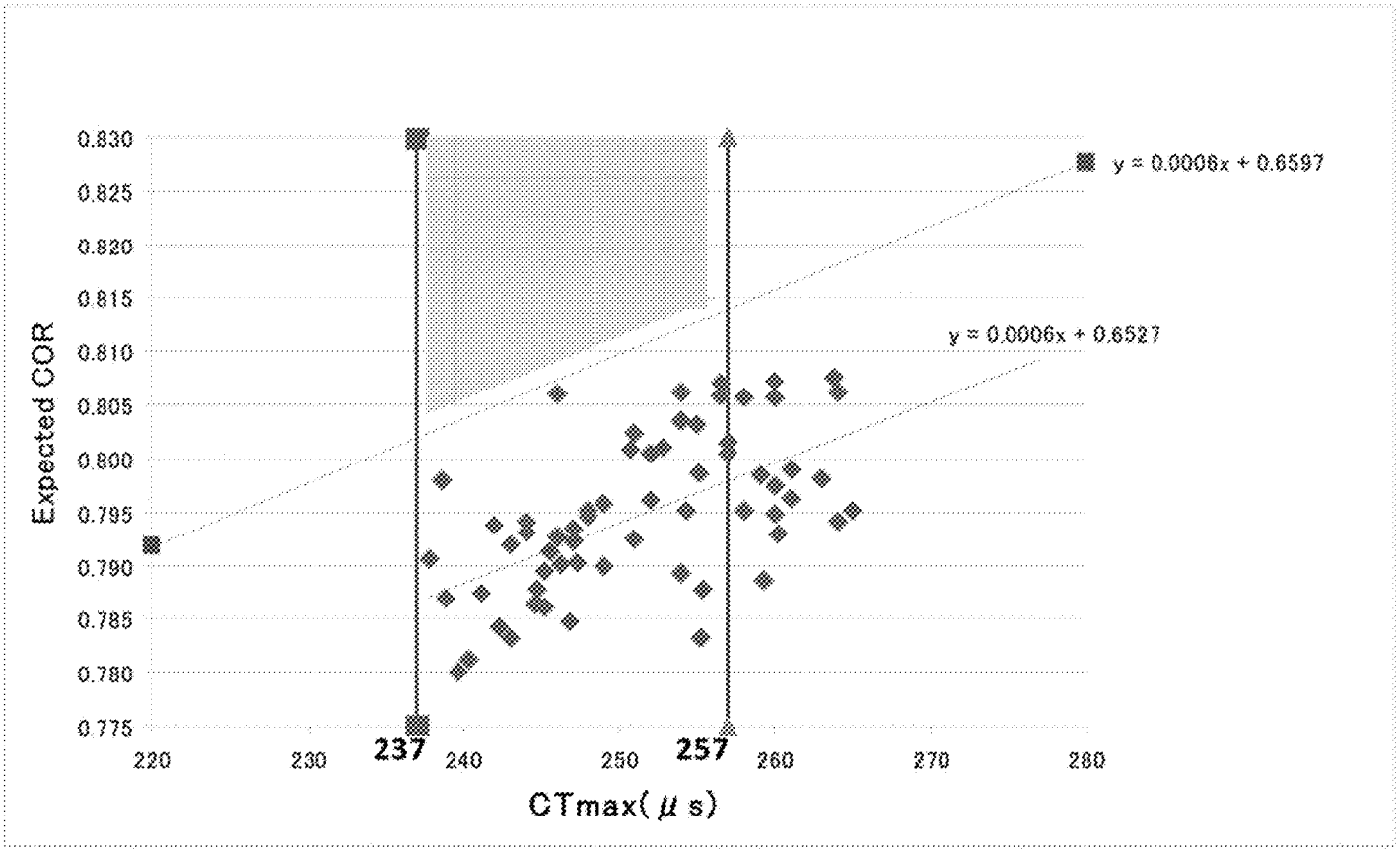
FIG. 13 is a graph showing relationship between expected COR and maximum value of characteristic time.

The golf club head 200 may satisfy the above expression instead of or together with the numerical range of the CT described above. FIG. 13 shows an example of the latter.

Figure 14:
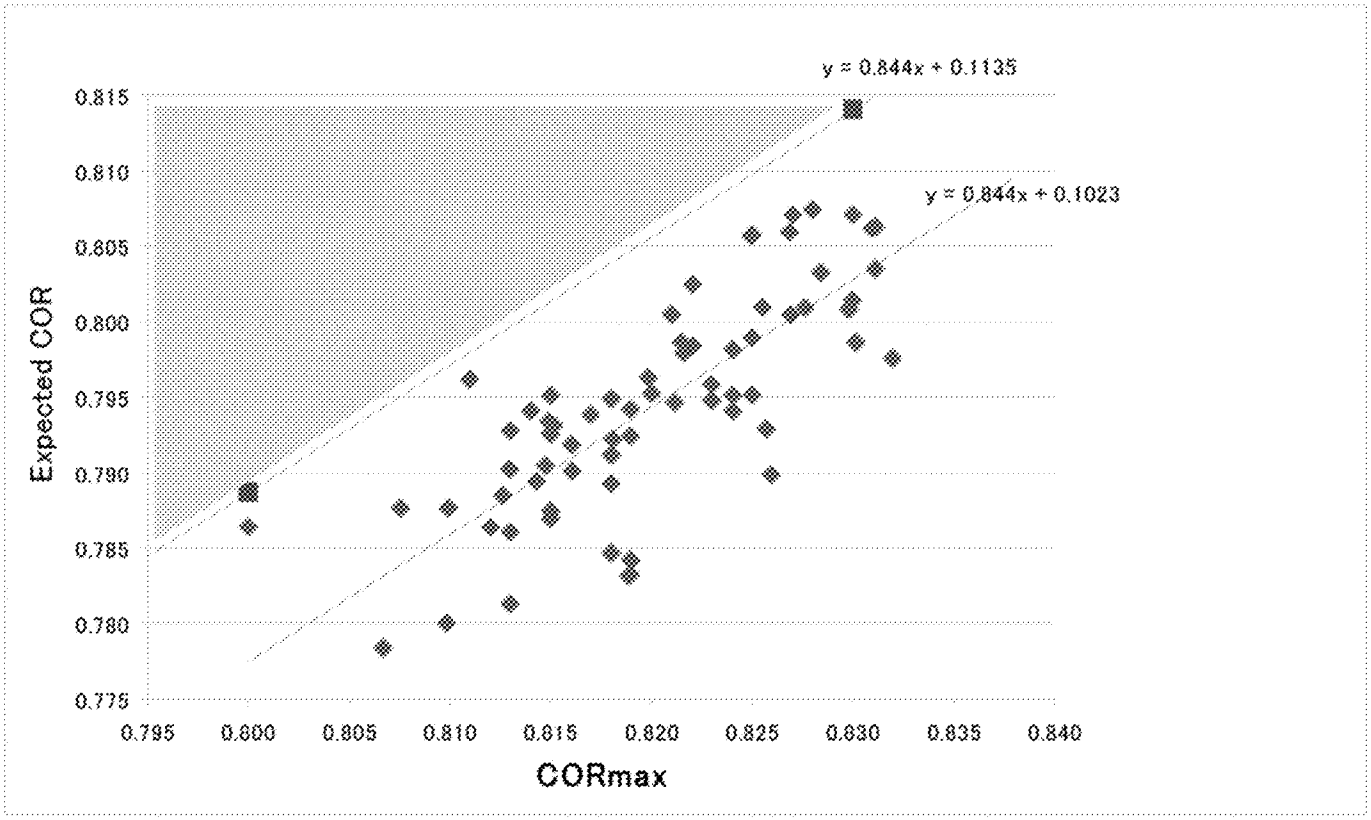
FIG. 14 is a graph showing relationship between expected COR and $COR_{max}$.

FIG. 14 shows results of examining the expected COR and the $COR_{max}$ for the conventional wood type golf club heads. According to experiments of the inventors, the expected COR and the $COR_{max}$ of the conventional wood type golf club heads are roughly summarized by the following regression expression:

$$\text{Expected COR}=0.844\times\text{COR}_{max}+0.1023.$$

In order to further increase the expected COR while maintaining relationship between the expected COR and the $COR_{max}$ of the conventional wood type golf club heads, the golf club head 200 may be configured so as to satisfy relationship of the following expression:

$$\text{Expected COR}\geq 0.844\times\text{COR}_{max}+0.1135.$$

The golf club head 200 may satisfy the above expression instead of or together with the numerical range of the CT described above.

Figure 15:
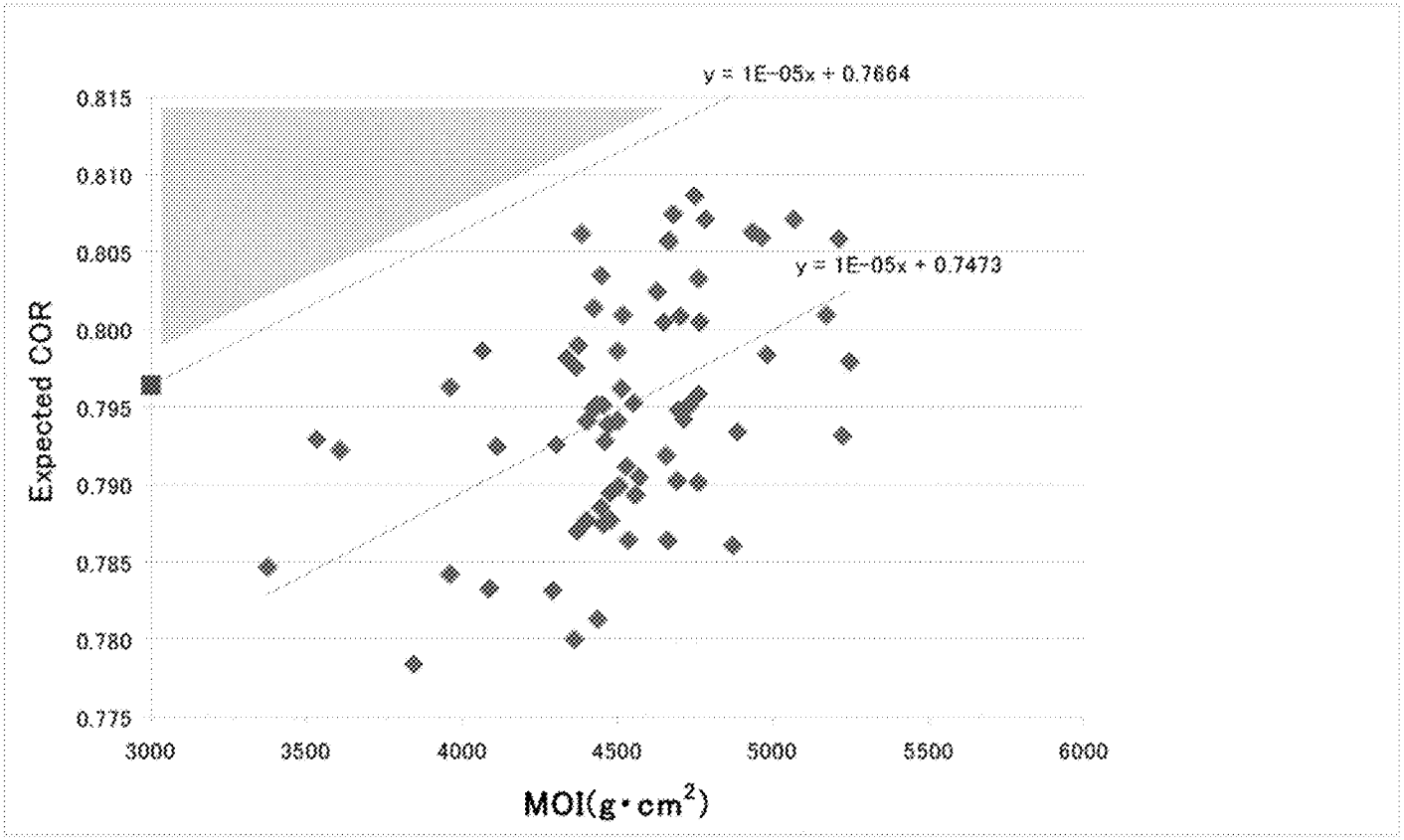
FIG. 15 is a graph showing relationship between expected COR and MOI.

FIG. 15 shows results of examining the expected COR and the value of the moment of inertia (MOI) ($g\cdot cm^2$) around the vertical axis passing through the center of gravity of the head for the conventional wood type golf club heads. According to experiments of the inventors, the expected COR and the MOI of the conventional wood type golf club heads are roughly summarized by the following regression expression:

$$\text{Expected COR}=0.00001\times\text{MOI}+0.7473.$$

In order to further increase the expected COR while maintaining relationship between the expected COR and the MOI of the conventional wood type golf club heads, the golf club head 200 may be configured so as to satisfy relationship of the following expression:

$$\text{Expected COR}\geq 0.00001\times\text{MOI}+0.7664.$$

The golf club head 200 as described above can be manufactured, for example, according to the third invention described above.

Table 2 shows some of more detailed examples of the golf club head 200 of the first invention. It should be noted, however, that the first invention should not be construed as being limited to such specific examples.

TABLE 2

| | Example 1 | Example 2 |
|---|---|---|
| Head mass (g) | 202 | 197 |
| Z-MOI ($g\cdot cm^2$) | 5200 | 5000 |
| $CT_{max}$ (microseconds) | 255 | 257 |
| $COR_{max}$ | 0.829 | 0.829 |
| Distance between position of $COR_{max}$ and position with highest impact frequency (mm) | 0.0 | 1.2 |
| Expected COR | 0.813 | 0.811 |

In Table 2, "Z-MOI" means the moment of inertia around the vertical axis passing through the center of gravity of the head.

The golf club heads of Examples 1 and 2 are hollow wood type heads with the head volume of 460 cc and are composed of a face member forming the striking face made of Ti-6Al-4V and a head main body member made of Ti-8Al-1Mo-1V.

The basic shape of the golf club head of Examples 1 and 2 is as shown in FIG. 9. As shown in FIG. 9, the striking face has a conventional contour shape, for example, a deformed oval contour shape longer in the heel-toe direction. The striking face 20 has a central region (A) including the face center FC and a toe side region (B) and a heel side region (C) respectively constituting the toe side and the heel side. Thickness of the central region (A) is larger than thickness of the toe side region (B) and the heel side region (C). Each of the regions (A) to (C) is configured to have essentially constant thickness.

The central region (A) has a substantially triangular shape in which each corner is rounded with a smooth circular arc. A first corner portion A1, which is an inner corner portion of the central region (A) including a smallest inner corner, is located on the toe side and on a side of the top wall portion. A second corner portion A2, which is one of the other two inner corner portions of the central region (A), is located on a side of the bottom wall portion at an approximate center in the heel-toe direction of the striking face 20. A third corner portion A3, which is the remaining inner corner portion of the central region (A), is located between the first corner A1 and the second corner A2 in the top-bottom direction on a side of the heel portion of the striking face 20. In Examples 1 and 2, the thickness of the central region (A) is about 3.6 mm. In another embodiment, the thickness of the central region (A) may be in a range of from 3.4 to 3.9 mm. In the golf club heads of Examples 1 and 2, the $CT_{max}$ is located in the vicinity of the first corner portion A1.

A transition region (D) in which the thickness gradually decreases toward a periphery thereof is formed around the central region (A). The transition region (D) is formed in an annular shape, for example, around the central region (A). That is, left and right portions of the transition region (D) are continuous to the toe side region (B) and the heel side region (C), respectively. Upper and lower portions of the transition region (D) are continuous to a top wall portion 40 and a bottom wall portion 50, respectively. To help understanding, in FIG. 9, boundary lines of the regions (A) to (D) are drawn on an outer surface of the striking face 20. Thickness change of the striking face 20 is realized by, for example, making an inner surface side of the striking face 20 uneven.

The toe side region (B) and the heel side region (C) are configured to have thickness of about 2.1 mm, for example. In a preferred embodiment, the thickness of the toe side region (B) and the heel side region (C) may be in a range of from 1.9 to 2.4 mm.

The invention claimed is:

1. A golf club head comprising:

a top portion;

a sole portion opposite the top portion; and a striking face configured to impact a golf ball, the striking face comprising a face center and a variable thickness distribution such that the club head exhibits an Expected COR value of not less than 0.810, the Expected COR value being determined based on the following relationship:

$$\text{Expected } COR = \sum_{i=1}^{n}\sum_{j=1}^{m} p_{ij} * c_{ij}$$

wherein:

(a) a virtual rectangular evaluation region is superimposed onto the striking face, the virtual rectangular evaluation region comprising a first pair of horizontal sides having a length of 45 mm, a second pair of vertical sides having a length of 25 mm, and a geometric center that coincides with the face center;

(b) the virtual rectangular evaluation region is divided into 5 rows (m) having an equal height of 5 mm and is divided into 9 columns (n) having an equal width of 5 mm, thereby forming a matrix of bins having coordinates i and j;

(c) $c_{ij}$ corresponds to an average COR value associated with bin i, j;

(d) $p_{ij}$ corresponds to a bin-specific impact probability value in accordance with the following:

$$P(i,\ j) = \begin{bmatrix} 0.79\% & 1.69\% & 1.97\% & 2.80\% & 3.12\% & 2.98\% & 2.55\% & 1.83\% & 1.22\% \\ 0.86\% & 1.69\% & 3.51\% & 4.09\% & 3.76\% & 4.41\% & 2.90\% & 1.79\% & 1.18\% \\ 0.75\% & 1.86\% & 3.33\% & 4.30\% & 4.70\% & 3.26\% & 3.62\% & 2.37\% & 1.15\% \\ 0.72\% & 1.90\% & 2.15\% & 2.76\% & 2.69\% & 2.87\% & 2.44\% & 1.25\% & 1.00\% \\ 0.47\% & 1.15\% & 1.15\% & 1.61\% & 2.44\% & 2.37\% & 2.01\% & 1.69\% & 0.68\% \end{bmatrix};$$

and (e) the golf club head exhibits a characteristic time no greater than 257 microseconds.

2. The golf club head according to claim 1, wherein the characteristic time is not less than 237 microseconds.

3. The golf club head according to claim 1, wherein the golf club head further comprises a maximum CT value, $CT_{max}$, that satisfies the following expression:

$$\text{Expected COR} \geq 0.0006 \times CT_{max} + 0.6597.$$

4. The golf club head according to claim 3, wherein the characteristic time is not less than 237 microseconds.

5. The golf club head according to claim 1, wherein the expected COR value and a maximum value $COR_{max}$ of the COR satisfy a following expression:

$$\text{Expected COR} \geq 0.844 \times COR_{max} + 0.1135.$$

6. The golf club head according to claim 1, wherein the expected COR value and a value of moment of inertia (MOI) ($g \cdot cm^2$) satisfy the following expression (4):

$$\text{Expected COR} \geq 0.00001 \times \text{MOI} + 0.7664; \text{ and}$$

wherein the MOI is the value of moment of inertia around a vertical axis passing through a center of gravity of the head in a reference position in which the golf club head is held at predetermined lie angle and loft angle.

7. The golf club head of claim 1, wherein the striking face further comprises a central thickened region located intermediate a heel region and a toe region, the central thickened region having a thickness greater than the heel region and the toe region.

8. The golf club head of claim 7, wherein the central thickened region comprises a generally constant thickness.

9. The golf club head of claim 7, wherein the central thickened region comprises a generally triangular shape.

10. The golf club head of claim 7, wherein the central thickened region comprises a thickness between 3.4 mm and 3.9 mm.

11. The golf club head of claim 10, wherein the heel region and the toe region each comprise a thickness between 1.9 mm and 2.4 mm.

12. A golf club head comprising:

a top portion;

a sole portion opposite the top portion; and a striking face configured to impact a golf ball, the striking face comprising (i) a face center, (ii) a central region having a thickness between 3.4 mm and 3.9 mm, (iii) a heel region, and (iv) a toe region, the heel region and the toe region each having a thickness between 1.9 mm and 2.4 mm such that the club head exhibits an Expected COR value of not less than 0.810, the Expected COR value being determined based on the following relationship:

$$\text{Expected } COR = \sum_{i=1}^{n} \sum_{j=1}^{m} p_{ij} * c_{ij}$$

wherein:

(a) a virtual rectangular evaluation region is superimposed onto the striking face, the virtual rectangular evaluation region comprising a first pair of horizontal sides having a length of 45 mm, a second pair of vertical sides having a length of 25 mm, and a geometric center that coincides with the face center;

(b) the evaluation region is divided into 5 rows (m) having an equal height of 5 mm and is divided into 9 columns (n) having an equal width of 5 mm, thereby forming a matrix of bins having coordinates i and j;

(c) $c_{ij}$ corresponds to an average COR value associated with bin i, j;

(d) $p_{ij}$ corresponds to a bin-specific impact probability value in accordance with the following:

$$P(i,\ j) = \begin{bmatrix} 0.79\% & 1.69\% & 1.97\% & 2.80\% & 3.12\% & 2.98\% & 2.55\% & 1.83\% & 1.22\% \\ 0.86\% & 1.69\% & 3.51\% & 4.09\% & 3.76\% & 4.41\% & 2.90\% & 1.79\% & 1.18\% \\ 0.75\% & 1.86\% & 3.33\% & 4.30\% & 4.70\% & 3.26\% & 3.62\% & 2.37\% & 1.15\% \\ 0.72\% & 1.90\% & 2.15\% & 2.76\% & 2.69\% & 2.87\% & 2.44\% & 1.25\% & 1.00\% \\ 0.47\% & 1.15\% & 1.15\% & 1.61\% & 2.44\% & 2.37\% & 2.01\% & 1.69\% & 0.68\% \end{bmatrix};$$

and (e) the golf club head exhibits a characteristic time no greater than 257 microseconds.

13. The golf club head according to claim 12, wherein the characteristic time is not less than 237 microseconds.

14. The golf club head according to claim 12, wherein the golf club head further comprises a maximum CT value, $CT_{max}$, that satisfies the following expression:

$$\text{Expected COR} \geq 0.0006\ ms^{-1} \times CT_{max} + 0.6597.$$

15. The golf club head according to claim 14, wherein the characteristic time is not less than 237 microseconds.

16. The golf club head according to claim 12, wherein the expected COR value and a maximum value $COR_{max}$ of the COR satisfy a following expression:

$$\text{Expected COR} \geq 0.844 \times COR_{max} + 0.1135.$$

17. The golf club head according to claim 12, wherein the expected COR value and a value of moment of inertia (MOI) ($g \cdot cm^2$) satisfy the following expression:

$$\text{Expected COR} \geq 0.00001 \times MOI + 0.7664; \text{ and}$$

wherein the MOI is the value of moment of inertia around a vertical axis passing through a center of gravity of the golf club head in a reference position in which the golf club head is held at predetermined lie angle and loft angle.

18. The golf club head of claim 12, wherein the central region comprises a generally constant thickness.

19. The golf club head of claim 12, wherein the central region comprises a generally triangular shape.

20. The golf club head of claim 12, wherein the central region comprises a thickness between 3.4 mm and 3.9 mm.

21. The golf club head of claim 12, wherein the striking face comprises a generally ovate shape.

* * * * *